US006701541B2

(12) United States Patent
Romagna et al.

(10) Patent No.: US 6,701,541 B2
(45) Date of Patent: Mar. 9, 2004

(54) ODOR TRAP FOR A WATERLESS URINAL

(75) Inventors: Jürg Romagna, Ennetbaden (CH); Erwin Schibig, Cham (CH)

(73) Assignee: Geberit Technik AG (CH)

( * ) Notice: Subject to any disclaimer, the term of this patent is extended or adjusted under 35 U.S.C. 154(b) by 0 days.

(21) Appl. No.: 10/117,449

(22) Filed: Apr. 5, 2002

(65) Prior Publication Data

US 2002/0166162 A1 Nov. 14, 2002

(30) Foreign Application Priority Data

Apr. 6, 2001 (CH) ..... 0656/01

(51) Int. Cl.[7] ..... E03D 13/00
(52) U.S. Cl. ..... 4/301; 4/679; 4/681; 137/247.35
(58) Field of Search ..... 4/301, 144.1, 679, 4/310, 311, 681; 137/247.35

(56) References Cited

U.S. PATENT DOCUMENTS

| | | | | | |
|---|---|---|---|---|---|
| 3,725,964 | A | * | 4/1973 | Whitsett | 4/679 |
| 3,751,734 | A | * | 8/1973 | Lumadue | 4/679 |
| 4,045,346 | A | * | 8/1977 | Swaskey | 210/164 |
| 4,190,910 | A | * | 3/1980 | Teglund et al. | 4/421 |
| 4,224,701 | A | * | 9/1980 | Huang | 4/679 |
| 4,244,061 | A | * | 1/1981 | Webster et al. | 4/144.1 |
| 5,305,473 | A | * | 4/1994 | Nakamura | 4/306 |
| 5,711,037 | A | | 1/1998 | Reichardt et al. | |
| 5,881,398 | A | * | 3/1999 | Franzen | 4/295 |
| 6,286,153 | B1 | | 9/2001 | Keller | |
| 6,319,397 | B1 | * | 11/2001 | Su et al. | 210/163 |
| 6,418,569 | B1 | * | 7/2002 | Knight | 4/287 |
| 6,425,411 | B1 | * | 7/2002 | Gorges | 137/247.39 |
| 2002/0069913 | A1 | * | 6/2002 | Gorges et al. | 137/247.13 |

FOREIGN PATENT DOCUMENTS

| | | | | | |
|---|---|---|---|---|---|
| GB | 2164965 | A | * | 9/1984 | E03C/1/288 |
| GB | 2216558 | A | * | 3/1988 | E03C/1/29 |
| JP | 52-74922 | A | * | 6/1977 | E03C/1/28 |
| JP | 3-115628 | A | * | 5/1991 | E03D/13/00 |
| JP | 3-206219 | A | * | 9/1991 | E03C/1/29 |
| WO | WO 97/15735 | A1 | | 5/1997 | |

* cited by examiner

*Primary Examiner*—Henry Bennett
*Assistant Examiner*—Amanda Flynn
(74) *Attorney, Agent, or Firm*—Webb Ziesenheim Logsdon Orkin & Hanson, P.C.

(57) ABSTRACT

An odor trap having a cup-shaped housing, which has an inlet located on an upper end and an outlet on a lower end leading into a drain line. A siphon blocks the passage of gas from the outlet to the inlet. A urine collector is configured in the shape of an inlet funnel. The inlet funnel empties into an open tube with a relatively narrow inside diameter.

20 Claims, 7 Drawing Sheets

ODOR TRAP FOR A WATERLESS URINAL

BACKGROUND OF THE INVENTION

1. Field of the Invention

This invention relates to an odor trap for a waterless or low-flush urinal, particularly to an odor trap with a cup-shaped housing that has an inlet located on an upper end and an outlet located on a lower end, with a siphon that blocks the passage of gas from the outlet to the inlet and with a urine collector in the shape of a funnel.

2. Description of the Related Art

Odor traps of this type have been known for a long time. They have the significant advantage that the urinal requires no water connection and no flushing device or that the urinal requires only a little water. In such urinals, however, it is difficult to guarantee the necessary hygiene and to completely prevent the occurrence of unpleasant odors. The prior art suggests numerous solutions to the problem. In WO 97/15735, for example, an odor trap is disclosed in which there is a sealing layer that consists of an oil. U.S. Pat. No. 5,711,037 teaches an odor trap in which a cup-shaped float is inserted in the inlet, which float is closed on top and open on the bottom. WO 99/57382 discloses an odor trap in which, below the inlet opening, there is a spherical float which floats in the collected urine and thereby closes the opening. During use, the float briefly opens the opening so that the urine can flow into the siphon. One problem with this odor trap, however, is that a residue of urine always remains above the float, which contributes significantly to the occurrence of an unpleasant odor.

SUMMARY OF THE INVENTION

The object of the invention is to create an odor trap of the type described above which is characterized by an even lower propagation of unpleasant odors and is also more reliable.

The invention teaches that this object is accomplished on an odor trap of the type described above wherein the inlet funnel empties into an open tube that has a relatively small inside diameter, and that on the lower end of the tube there are surfaces for the condensation of the odorous substances that are given off. The tube with the relatively narrow inside diameter reduces the ascending air current which carries the odorous substances. Before the odorous substances that are produced can enter the tube, they condense at least partly on the above mentioned surface. The quantity of odorous substances is therefore largely retained by the above mentioned surfaces and the condensation on these surfaces as well as by the minimization of the passage opening. Tests have shown that the condensation is particularly effective when the above mentioned surfaces are realized in a shape similar to that of an Erlenmeyer flask. Alternatively, hemispheric surfaces are also suitable, along which the exiting air must flow and on which the odorous substances produced condense at least partly. In one development of the invention, the generation of unpleasant odors is suppressed particularly effectively if an additional siphon that has a relatively small surface area is located above the main siphon. The effect is further enhanced if two or more such siphons are arranged in a cascade fashion.

In one development of the invention, the odorous substances are extracted above the main siphon by means of a fan. In a development of the invention, the odorous substances extracted are transported to the drain line. The extracted air can also be cleaned in a filter, for example by means of activated carbon or with catalytic deodorization. The formation of odors in the body of the urinal itself can then be prevented, while in one development of the invention, the extracted air is introduced into the urinal body so that it flows downward on the inside of the urinal body into the inlet of the odor trap. Odorous substances in the urinal body are then carried along by the air and can be removed in a filter.

Additional advantageous features of the invention are described in greater detail in the dependent claims, in the following description and are illustrated in the accompanying drawings.

DETAILED DESCRIPTION OF THE PREFERRED EMBODIMENTS

Figure 1:
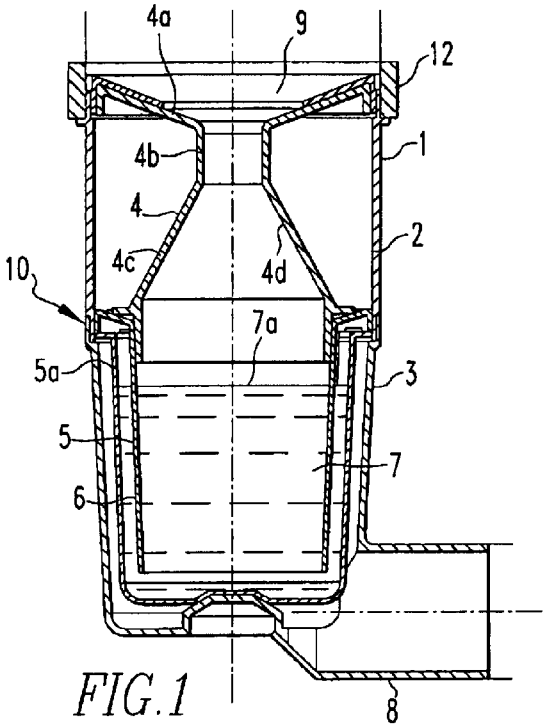
FIG. 1 is a vertical section view through an odor trap according to the present invention.
Figure 2:
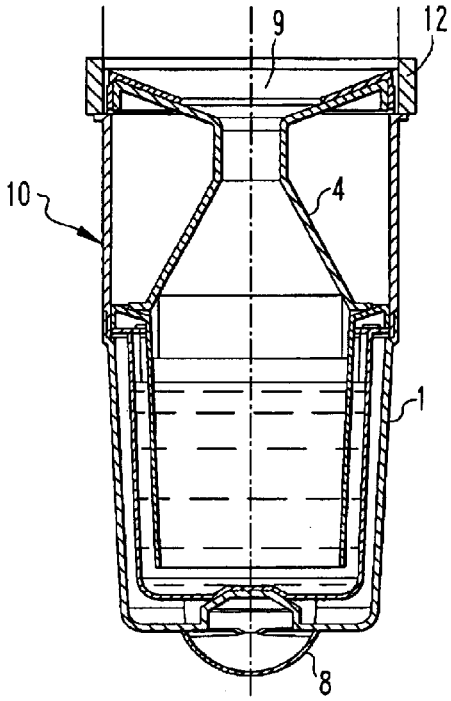
FIG. 2 is a vertical section view through the odor trap illustrated in FIG. 1.
Figure 3:
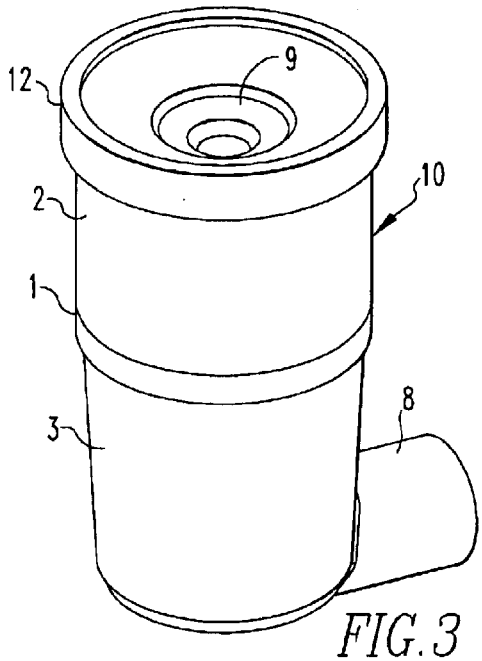
FIG. 3 is a perspective view of the odor trap illustrated in FIGS. 1 and 2.
Figure 4:
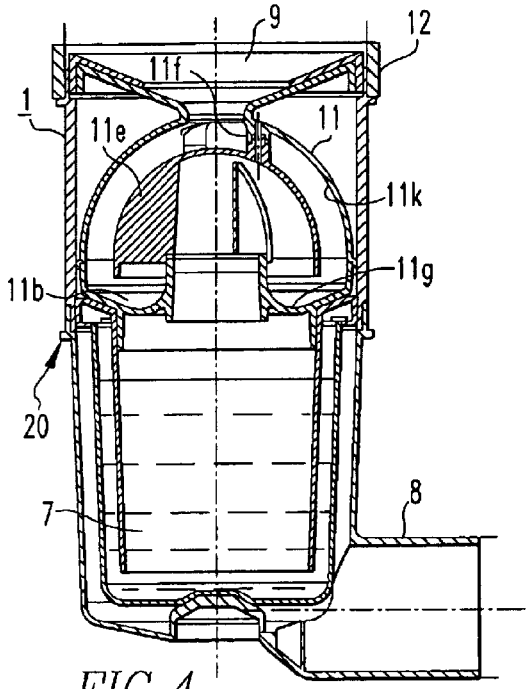
FIG. 4 is a vertical section view through an odor trap in another embodiment according to the present invention.
Figure 5:
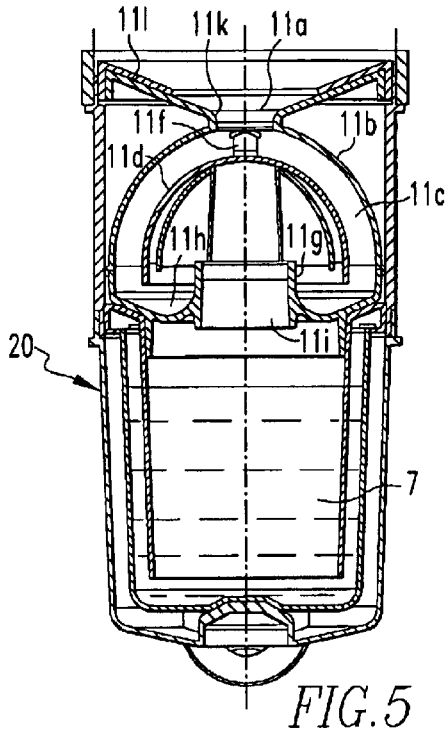
FIG. 5 is a section view through the odor trap illustrated in FIG. 4.

The odor trap 10 illustrated in FIGS. 1–3 has a cup-shaped housing 1 which is composed of an upper housing part 2 and a bottom housing part 3. The two parts 2 and 3 can be permanently connected to each other, by welding for example. On the lower end of the housing 1 there is an outlet pipe 8 which is connected to a drain line which is not shown here. Inserted into the lower housing part 3 is an overflow container 5 which has openings 5*a* on the top, into which a submerged tube 6 is inserted. The overflow container 5 and the submerged tube 6 with the collected urine 7 form a siphon which prevents the ascent of air and odorous substances from the drain line into the inlet 9.

Introduced into the housing 1, from above, is an insert 4 which is supported on the submerged tube 6 and which is fastened with a removable retaining ring 12 on the upper edge of the housing 1. The insert 4 has an inlet funnel 4*a* which extends essentially over the entire width of the housing 1, is comparatively flat and has an opening angle of significantly more than 45°. The inlet funnel 4*a* empties into an open tube 4*b*, the inside diameter of which is significantly narrower than the conically expanded area. The tube 4*b* empties at a lower end into a conically widening area 4*c* which has a correspondingly conical inside 4*d*. The tube 4*d* and the area 4*c*, as shown, have the shape of an Erlenmeyer flask, whereby only the bottom of the flask is missing. If odorous substances are given off from the surface 7*a* of the urine 7, they travel into the insert 4. These odorous substances are partly condensed on the sloping wall 4*d* of the area 4*c* and return to the urine 7. The constriction created by the tube 4*b* also reduces the flow of air upward into the inlet 9. The insert with the inlet funnel 4*a*, the tube 4*b* and the area 4*c* forms a unit and can be replaced following the removal of the retaining ring 12. Because the unit 4 can be manufactured very economically from plastic, a comparatively frequent replacement is very economical and can also be done very quickly.

The odor trap 20 illustrated in FIGS. 4–7 also has the above mentioned housing 1 with the drain pipe 8 and an inlet 9. The odor trap 20 differs from the odor trap 10 by an insert 11 which, however, is also one-piece and replaceable. The insert 11 has an inlet funnel 111 which corresponds to the inlet funnel 4*a* and which empties into a comparatively short tube 11*k* that a comparatively narrow inside diameter. Below the tube 11*k* the wall makes a transition into a hemispherical area 11 *b* in which a hemispherical part 11*d* is fastened by means of webs 11*f*. Between the area 11*b* and the part 11*d* there is a space 11*c* which is open to an passage 11*a*. The part 11*d* forms a siphon with a ring-shaped part 11*b*. The part 11*d* is thereby immersed with its lower edge in the urine (not shown here), which collects in the ring-shaped part 11*h*. A sleeve-shaped area 11*g* of the part 11*h* forms a vertical passage. Odorous substances given off from the urine 7 travel through the passage 11*i* into the interior of the part 11*d*. However, these odorous substances cannot escape from the interior because the passage into the space 11*c* is blocked by the siphon which is formed by the part 11*h* and the part 11*d*. However, odorous substances given off from the urine in this siphon can travel into the space 11*c*. During the upward flow of the air to the passage 11*a*, however, these odorous substances condense at least partly on the inside of the area 11*b* and flow back into the above mentioned siphon. The quantity of odorous substances given off that can get into the space 11*c* is significantly less than the quantity of the odorous substances that can be given off from the urine 7 because the surface of the siphon which is formed by the parts 11*h* and 11*d* is significantly smaller than the surface of the urine 7.

Figure 6:
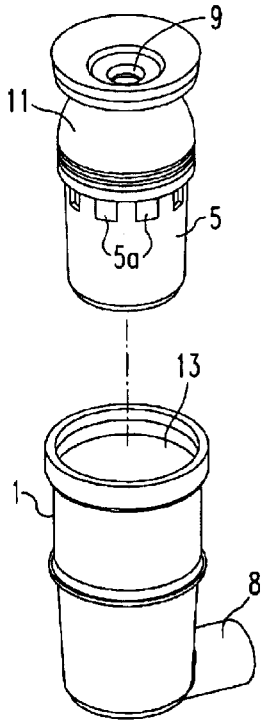
FIG. 6 is a perspective view of an odor trap, whereby an insert is shown in an elevated position.
Figure 7:
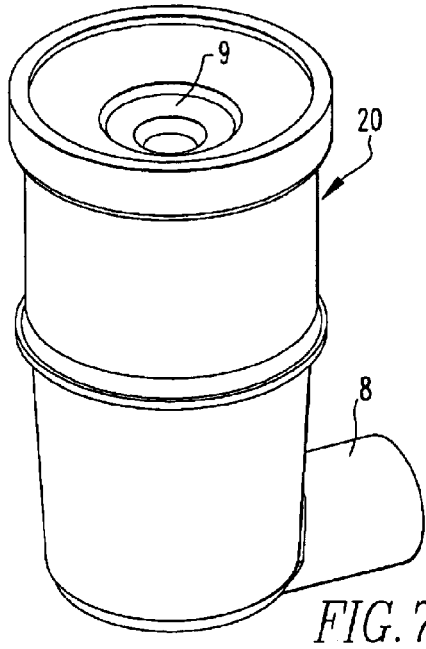
FIG. 7 is a perspective view of the odor trap illustrated in FIGS. 4 and 5.
Figure 8:
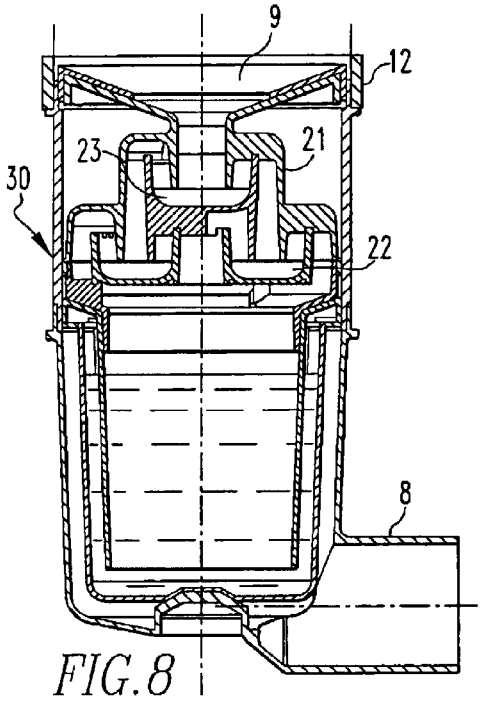
FIG. 8 is a vertical section view through an odor trap in an additional embodiment according to the present invention.
Figure 9:
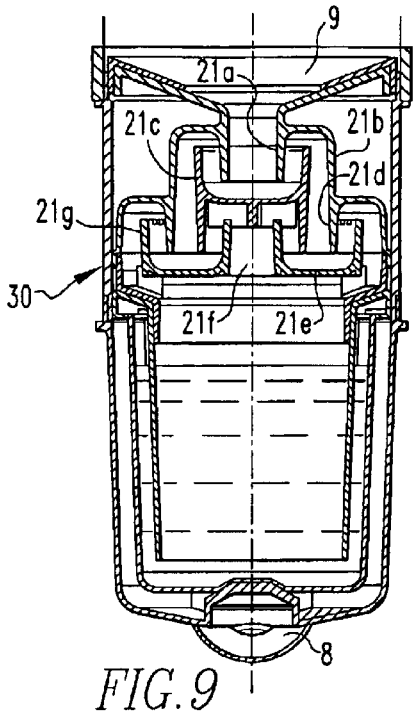
FIG. 9 is a vertical section view through the odor trap illustrated in FIG. 8.
Figure 10:
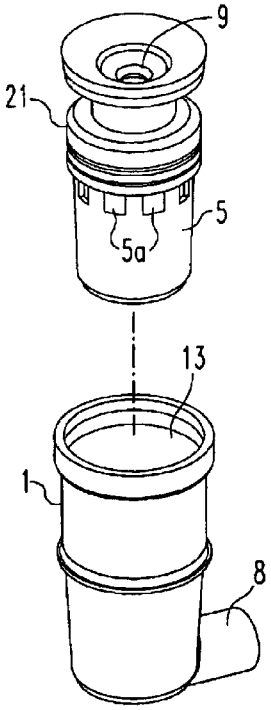
FIG. 10 is a perspective view of the odor trap illustrated in FIGS. 8 and 9, whereby an insert is shown in an extracted position.
Figure 11:
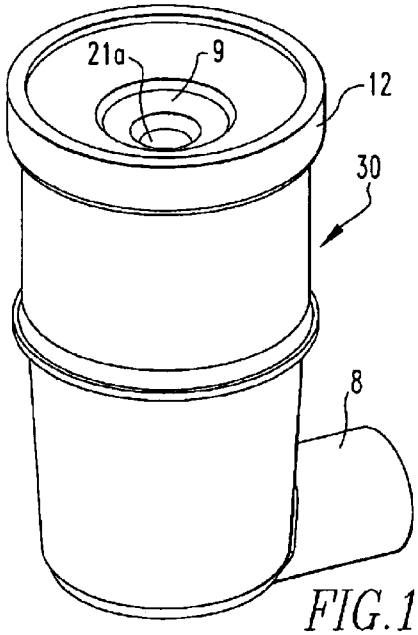
FIG. 11 is a perspective view of the odor trap illustrated in FIGS. 8 and 9.
Figure 12:
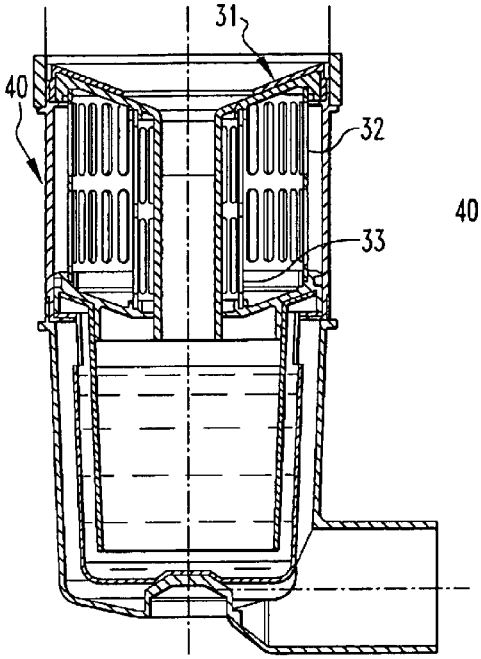
FIG. 12 is a vertical section view through an additional embodiment of an odor trap according to the present invention.
Figure 13:
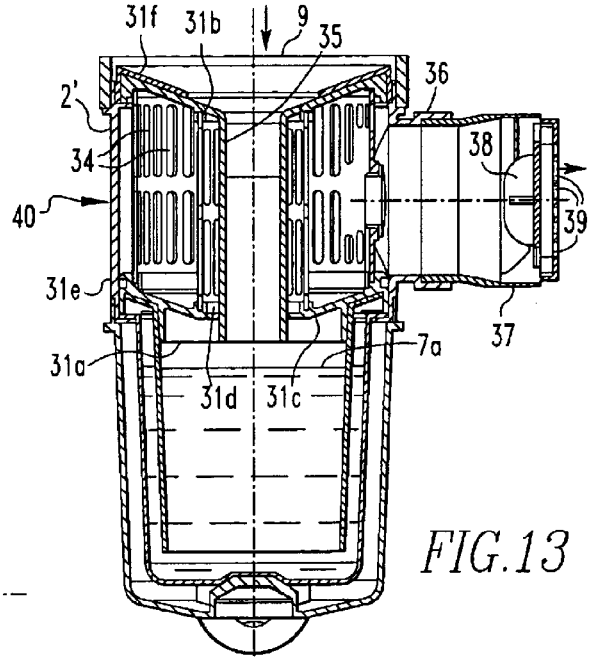
FIG. 13 is a section view through the odor trap illustrated in FIG. 12.

FIG. 6 shows the insert 11 to which the plunger body 5 is fastened. The plunger body 5 can therefore be easily replaced together with the housing 1.

FIGS. 8 to 11 show an odor trap 30 which has an insert 21 which is constructed in the manner of a cascade. The insert 21 consists of an upper part 21*b*, an inner part 21*c* and a lower part 21*e*. The upper part 21*b* has, in the center, a vertical, tubular pipe 21*a* through which urine travels from the inlet 9 into a cup 21*c*, whereby the pipe 21*a* projects into this cup 21*c*. The pipe 21*a*, with the cup 21*c*, forms a first siphon 23. Overflowing urine travels from the cup 21*c* into a cup 21*g* underneath it which forms another siphon 22 with an upwardly projecting pipe 21*f*. Overflowing urine ultimately travels from the cup 21*g* into the overflow container 5. The cascade arrangement makes it possible for the surface of the urine, from which the odorous substances can escape by evaporation, to be kept very small. The surface area of the urine that emits the odorous substances is reduced by the siphon 22 and is further reduced by the siphon 23. Substances exiting the siphon 23 are also condensed on the walls of the pipe 21*a* at least partly and travel back into the siphon 23.

Figure 14:
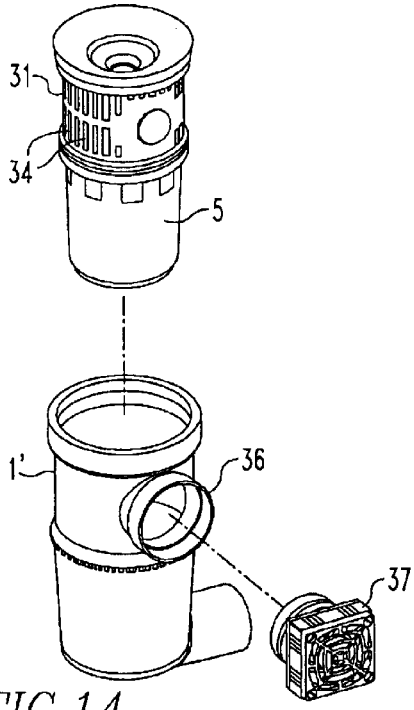
FIG. 14 is a perspective view of the odor trap illustrated in FIGS. 12 and 13, whereby an insert and a fan are shown in an extracted position.
Figure 15:
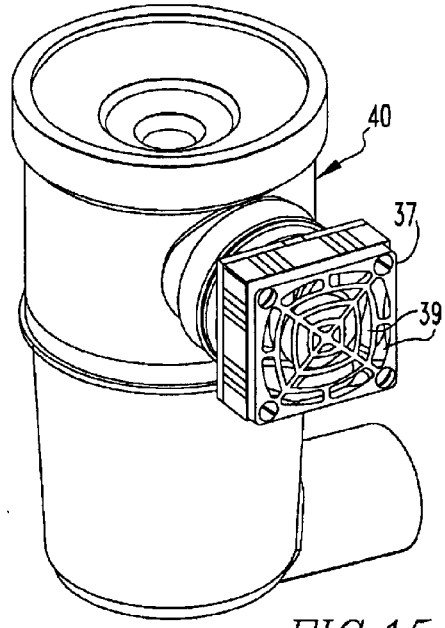
FIG. 15 is a perspective view of the odor trap illustrated in FIGS. 12 and 13.

The odor trap 40 illustrated in FIGS. 12 to 15 is provided with a likewise replaceable insert 31, which consists essentially of an upper funnel-shaped part 31*b*, a lower plate-shaped part 31*a* and two parts 32 and 33 that are held between these two parts. The parts 32 and 33 are located at some distance from each other and each have a plurality of rectangular openings 34 and 35. The part 31*a* has, in the center, an opening 31*d* through which the funnel-shaped part 31*b* projects with its tubular lower portion. An upper housing part 2' is provided with a tube 36 which extends radially outward and in which a fan 37 is inserted. This fan 37 can be an axial fan and can have a rotor 38 which is operated with an electric motor which is not shown here. This fan 37 generates a forced air current, as a result of which air flows from the inlet 9 through the part 31*b* downward toward the surface 7*a* of the urine 7. Through the opening 31*d*, the air then travels upward and through the slot-shaped holes 35 and 34 radially and in the peripheral direction outward and through the pipe 36 to the fan 37, and finally through openings 39 into a drain tube not shown here or into another type of line that leads away. After the entry through the inlet 9, this air current carries odorous substances with it, and these odorous substances are ultimately transported with the air current into the above mentioned line As shown in FIG. 14, the insert 31 can in this case also be replaced with the housing 1'.

Figure 16:
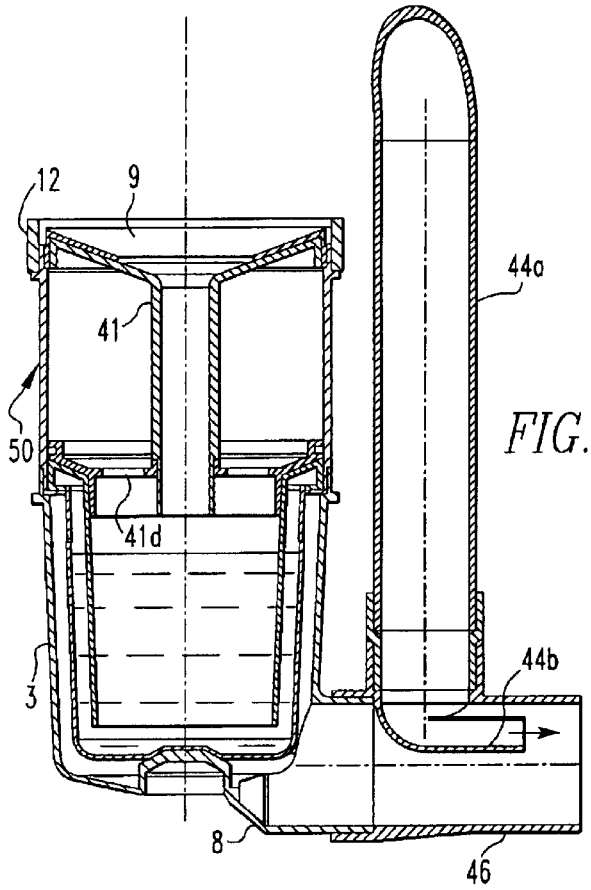
FIG. 16 is a vertical section view through an additional embodiment of an odor trap according to the present invention.
Figure 17:
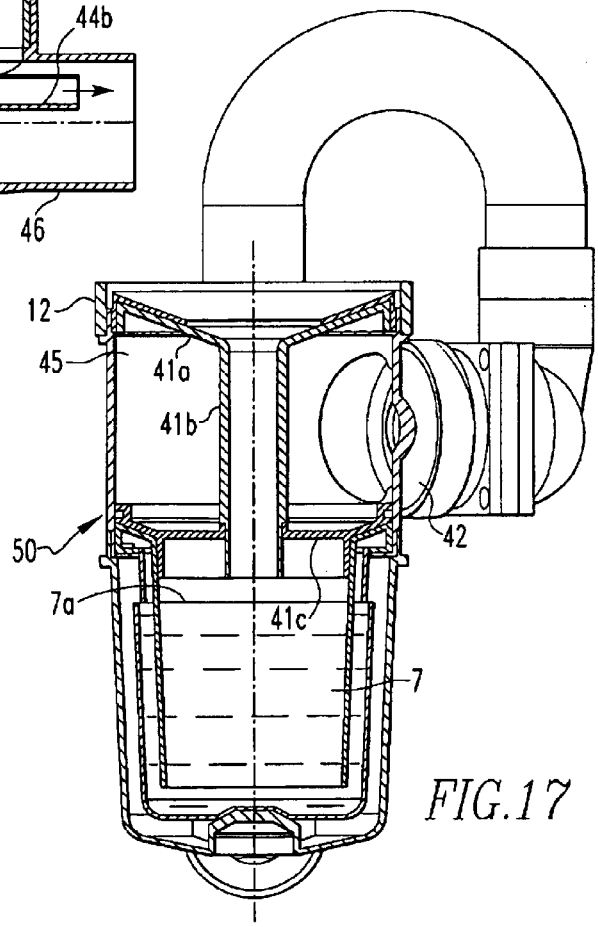
FIG. 17 is a vertical section view through the odor trap illustrated in FIG. 16.
Figure 18:
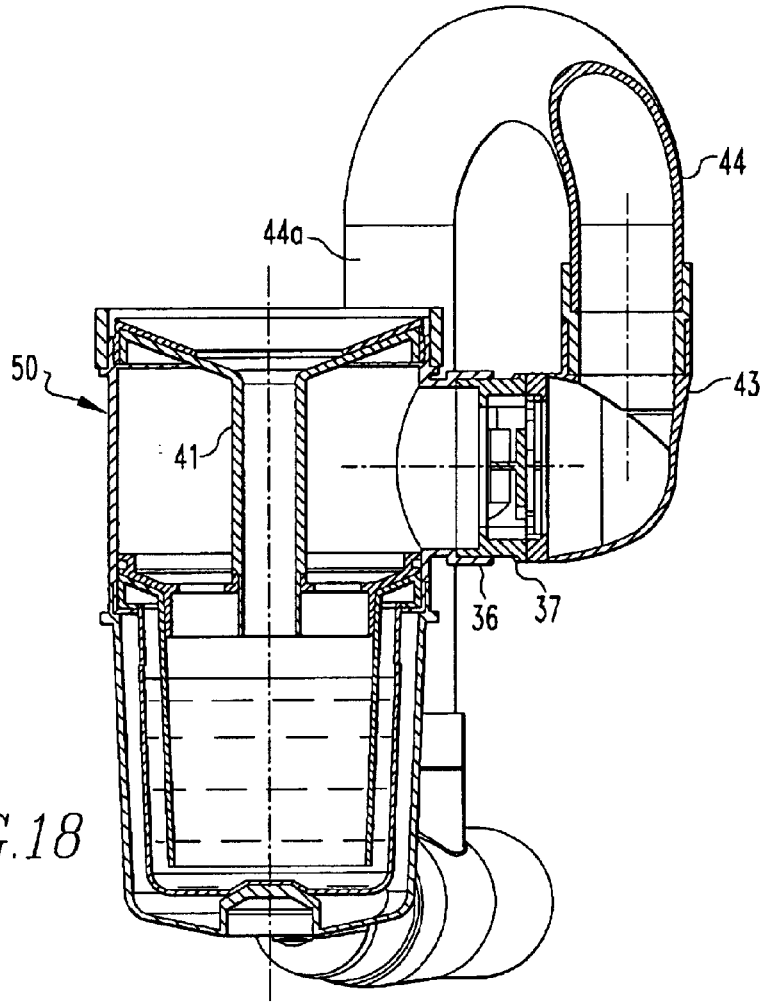
FIG. 18 is vertical section view through the odor trap illustrated in FIG. 16.
Figure 19:
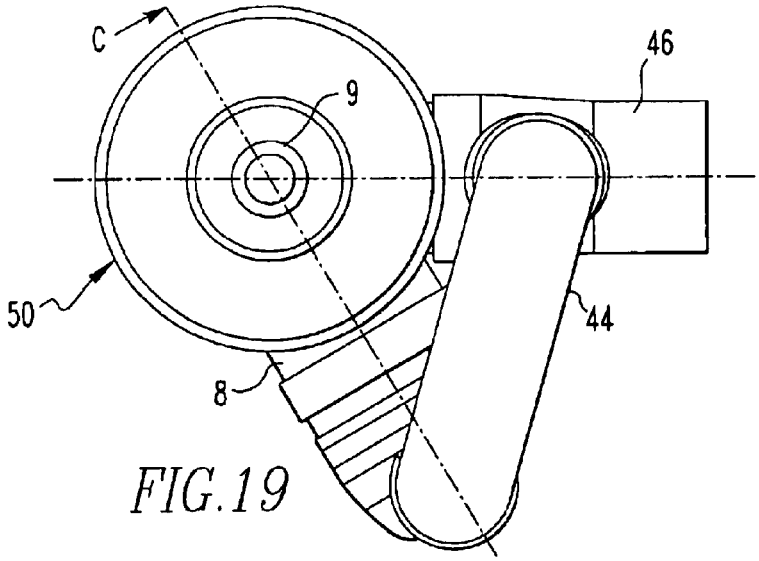
FIG. 19 is a plan view of the odor trap illustrated in FIG. 16.

The odor trap 50 illustrated in FIGS. 16 to 19 has an insert 41 which has an inlet funnel 41*a* which emerges into a cylindrical tube 41*b* which projects downward. Fastened to a lower end of the tube 41*b* is a disc-shaped part 41*c* which, as shown in FIG. 16, has a plurality of penetrations 41*d*. These penetrations 41*d* lead into a ring-shaped space 45 which is formed by an upper housing part 1" and the insert 41. Shaped onto the housing part 1" is a pipe 42 in which a fan 37 is inserted. The outlet of this fan 37 leads into a connecting piece 43 and from there into a curved tube segment 44 which is connected in a downward-pointing area 44 with the pipe 8 of the bottom housing part 3. The fan 37 generates an air current through which fresh air at the inlet 9 flows in through the tube 41*b* toward the surface 7*a*. Through the openings 41*d*, this sucked-in air travels into the ring-shaped space 45 to the fan 37 and finally via the tube segment 44 into a pipe 46 which is connected to a drain line not shown here. The air flowing in at the inlet 9 carries odorous substances with it and ultimately transports them into the above mentioned drain line. Through a deflector segment 44*b*, as shown in FIG. 16, the air carrying the odorous substances is introduced into the drain line, whereby the deflector segment forms a check valve.

Figure 20:
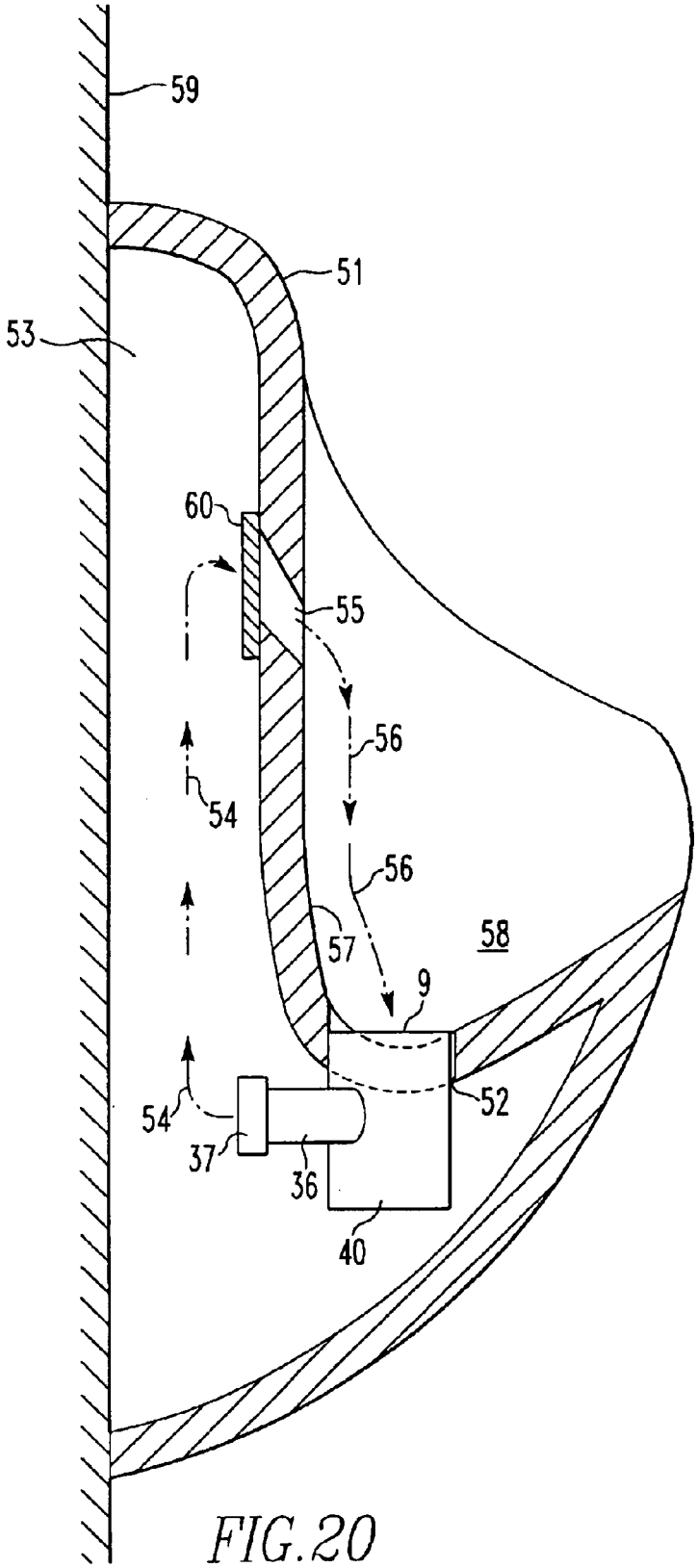
FIG. 20 is a schematic vertical section view through a urinal with an odor trap according to the present invention.

Alternatively to the above mentioned extraction of the air carrying the odorous substances, in the arrangement illustrated in FIG. 20, the air laden with odorous substances is conducted into a space 53 which is formed by a urinal body 31 and a building wall 59. The urinal body 51 is fastened as usual to the building wall 59 and the space 53 is realized in the conventional manner. The air laden with odorous substances introduced into the space 53 travels upward, as shown by the parts 54. In the urinal body 51, above the odor trap 40, there are one or more passage channels 55, through which the aid laden with odorous substances travels outward into the cup 58 and ultimately to the inside wall 57 downward toward the inlet 9. The odor trap 40 which is inserted as usual in an opening 52 of the urinal body 51, as a result of the suction force of the fan 37 at the inlet 9, collects the air present in the cup 58, which is normally likewise laden with odorous substances. Located in front of the channel 55 is an odor filter 60 which can contain activated carbon, for example. However, it can also be located somewhere else, in particular also on the odor trap 40 and can be replaced at appropriate intervals of time. The location shown in FIG. 32 has the significant advantage that the air present in the cup 58 is also constantly or periodically sucked out and cleaned. Instead of the odor trap 40, a correspondingly modified odor trap 50 can also be provided. In an additional conceivable realization, the fan 37 is not located directly on the odor trap 40, but at another point in the air circulation system, for example in front of the channel 55.

What is claimed is:

1. An odor trap for one of a waterless and a low-water urinal, comprising a cup-shaped housing having an inlet located on an upper end and an outlet on a lower end that leads into a drain line; a siphon configured to block the passage of gas from the outlet to the inlet; and a replaceable insert in the form of a urine collector in the shape of an inlet funnel configured to empty into a tube with a relatively small inside diameter, wherein the replaceable insert consists of the inlet funnel located on an upper end of the inlet, conical surfaces at the lower end of this inlet, wherein these surfaces create a conically expanding area and the tube with a relatively small inside diameter that is located between the inlet funnel and the conical surfaces for the condensation of the odorous substances.

2. The odor trap as claimed in claim 1, wherein the tube on a lower end emerges in an area and with it forms a flask having properties substantially similar to an Erlenmeyer flask.

3. The odor trap as claimed in claim 2, wherein the insert forms a replaceable unit within a housing.

4. The odor trap as claimed in claim 2, wherein the insert forms at least one siphon.

5. The odor trap as claimed in claim 3, wherein the insert forms at least one siphon.

6. The odor trap as claimed in claim 1, wherein the insert forms at least one ring shaped siphon.

7. The odor trap as claimed in claim 6, wherein the insert forms at least two ring-shaped siphons located in a cascade arrangement.

8. The odor trap as claimed in claim 6, wherein the at least one ring-shaped siphon is realized so that the surface of the urine collected in it is smaller than the corresponding surface of the siphon which blocks the outlet to the inlet.

9. The odor trap as claimed in claim 4, wherein the at least one ring-shaped siphon is realized so that the surface of the urine collected in it is smaller than the corresponding surface of the siphon which blocks the outlet to the inlet.

10. The odor trap as claimed in claim 1, further comprising a fan that generates an air current in the housing by which fresh air is sucked in at the inlet.

11. The odor trap as claimed in claim 10, wherein the air sucked in by the fan is fed via a line to a drain pipe.

12. The odor trap as claimed in claim 10, wherein the fan is an axial fan.

13. The odor trap as claimed in claim 12, wherein the fan is located in an upper area of the housing on a pipe extending radially away.

14. The odor trap as claimed in claim 12, wherein the air sucked in by the fan is fed in a circulation system into an interior space of a urinal body and is introduced through a passage into the urinal cup.

15. The odor trap as claimed in claim 12, wherein the air sucked in by the fan is fed via a line to a drain pipe.

16. The odor trap as claimed in claim 10, wherein the fan is located in an upper area of the housing on a pipe extending radially away.

17. The odor trap as claimed in claim 16, wherein the air sucked in by the fan is fed in a circulation system into an interior space of a urinal body and is introduced through a passage into the urinal cup.

18. The odor trap as claimed in claim 10, wherein the air sucked in by the fan is fed in a circulation system into an interior space of a urinal body and is introduced through a passage into the urinal cup.

19. The odor trap as claimed in claim 18, wherein the circulating air is cleaned during every passage by a filter.

20. The odor trap as claimed in claim 19, wherein the circulating air is cleaned by activated carbon.

* * * * *